US006126508A

United States Patent [19]

Chou

[11] Patent Number: 6,126,508

[45] Date of Patent: Oct. 3, 2000

[54] MOTION TOY

[76] Inventor: Jin-Long Chou, 10F, No. 218, Sec. 3, Da-Tung Rd. Hsi-Chih Chen, Taipei Hsien, Taiwan

[21] Appl. No.: 09/159,227

[22] Filed: Sep. 23, 1998

[51] Int. Cl.[7] ..... A63H 13/00

[52] U.S. Cl. ..... 446/358; 446/352; 446/376; 446/379

[58] Field of Search ..... 446/298, 330, 446/352, 353, 354, 358, 376, 379, 380; 40/414, 415, 418, 419, 420

[56] References Cited

U.S. PATENT DOCUMENTS

| | | | |
|---|---|---|---|
| 674,970 | 5/1901 | Kennedy . | |
| 711,510 | 10/1902 | Little . | |
| 1,415,344 | 5/1922 | Haskell . | |
| 1,423,383 | 7/1922 | Zaiden . | |
| 1,674,943 | 6/1928 | Berger . | |
| 1,685,358 | 9/1928 | Harcourt . | |
| 2,637,936 | 5/1953 | Dale et al. . | |
| 2,691,845 | 10/1954 | Jepson . | |
| 3,613,299 | 10/1971 | Amici et al. . | |
| 3,643,374 | 2/1972 | Gunther et al. . | |
| 3,660,931 | 5/1972 | Gardel et al. . | |
| 3,888,023 | 6/1975 | Genin . | |
| 4,040,206 | 8/1977 | Kimura | 446/352 |
| 4,136,874 | 1/1979 | McCord . | |
| 4,217,726 | 8/1980 | Flciker et al. | 446/330 |
| 4,505,472 | 3/1985 | Lorenc . | |
| 4,512,748 | 4/1985 | Matsumoto et al. | 446/352 |
| 4,545,775 | 10/1985 | Kim . | |
| 4,605,382 | 8/1986 | Cook et al. | 446/330 |
| 4,676,764 | 6/1987 | Yeu . | |
| 4,801,285 | 1/1989 | Yeu . | |
| 4,802,878 | 2/1989 | Terzian et al. | 446/352 |
| 4,828,530 | 5/1989 | Lee . | |
| 4,836,819 | 6/1989 | Oishi et al. . | |
| 4,846,752 | 7/1989 | Combs . | |
| 4,867,730 | 9/1989 | Lee . | |
| 4,869,703 | 9/1989 | Ong . | |
| 4,878,874 | 11/1989 | Terzian . | |
| 4,878,878 | 11/1989 | Bittner . | |
| 4,889,027 | 12/1989 | Yokoi . | |
| 4,901,459 | 2/1990 | Lee . | |
| 4,923,428 | 5/1990 | Curran . | |
| 4,944,708 | 7/1990 | Kawabe . | |
| 5,022,533 | 6/1991 | Lin . | |
| 5,147,238 | 9/1992 | Kelley et al. . | |
| 5,176,560 | 1/1993 | Wetherell et al. . | |
| 5,205,775 | 4/1993 | Brodrib . | |
| 5,224,896 | 7/1993 | Terzian . | |
| 5,259,806 | 11/1993 | Chang . | |
| 5,273,479 | 12/1993 | Chang . | |
| 5,318,471 | 6/1994 | Glovier . | |
| 5,609,340 | 3/1997 | Chuang . | |
| 5,700,178 | 12/1997 | Cimerman et al. . | |
| 5,735,726 | 4/1998 | Cohen . | |
| 5,911,617 | 6/1999 | Chou . | |
| 5,941,756 | 8/1999 | Chou . | |
| 6,022,263 | 2/2000 | Liu et al. | 446/330 |

FOREIGN PATENT DOCUMENTS

| | | | |
|---|---|---|---|
| 535765 | 12/1958 | Belgium . | |
| 1009558 | 5/1952 | France | 446/352 |
| 2063691 | 6/1981 | United Kingdom | 446/300 |
| 2221401 | 2/1990 | United Kingdom . | |

*Primary Examiner*—Kien T. Nguyen
*Assistant Examiner*—Jeffrey D. Carlson
*Attorney, Agent, or Firm*—Smith Gambrell & Russell, LLP

[57] ABSTRACT

A motion toy includes a hollow base having two upright top lugs, two leg members respectively pivoted to the two upright top lugs, a trunk member pivoted to the leg members remote from the base, a head member pivoted to the trunk member, a transmission gear meshed between a toothed portion at one leg member and a bottom rack at the head member, spring means connected between the leg members to pull the leg members toward each other, and a power drive mounted inside the hollow base and controlled to turn the leg members back and forth on the upright top lugs.

4 Claims, 7 Drawing Sheets

MOTION TOY

BACKGROUND OF THE INVENTION

The present invention relates to a motion toy, and more particularly to such a motion toy which comprises two leg members pivotally connected to a hollow base and oscillated by a motor drive in the hollow base, a trunk member pivotally connected to the leg members, a head member pivotally connected to the trunk member, and coupling means coupled between the head member and one leg member.

In regular motion toys, a reversible motor is used to drive a gear train, causing the gear train to reciprocate reciprocating rods or to turn eccentric wheels in moving the hands and the head of the toy. These conventional structures of motion toys are commonly complicated, further they cannot achieve a fine and delicate motion when operated.

SUMMARY OF THE INVENTION

The present invention provides a motion toy which achieves a fine and delicate motion when operated. According to one embodiment of the present invention, the motion toy comprises a toy body, and a motor drive. The toy body comprises a hollow base, a head member, a trunk member, and two leg members. The hollow base comprises two upright lugs raised from a top side wall thereof. The head member comprises a smoothly arched bottom rack, and a transverse pivot hole above the bottom rack. The trunk member comprises a top pivot disposed at a top side and pivoted to the transverse pivot, hole of the head member, two bottom pivots bilaterally disposed at a bottom side, a transverse axle spaced between the top pivot and the bottom pivots, and a transmission gear mounted on the transverse axle and meshed with the bottom rack of the head member. The leg members each have a first pivot hole at one end respectively pivoted to the bottom pivots of the trunk member, and a second pivot hole at an opposite end respectively coupled to the pivot holes of the upright lugs of the hollow base. One leg member has a smoothly arched toothed portion at one end meshed with the transmission gear, and a sector gear at an opposite end inserted through a hole on the hollow base. The motor drive is mounted inside the hollow base and is controlled to move the toy body. The motor drive comprises a reversible motor, and a gear transmission mechanism meshed with the sector gear and driven by the reversible motor to move the sector gear.

DETAILED DESCRIPTION OF THE PREFERRED EMBODIMENT

Figure 1:
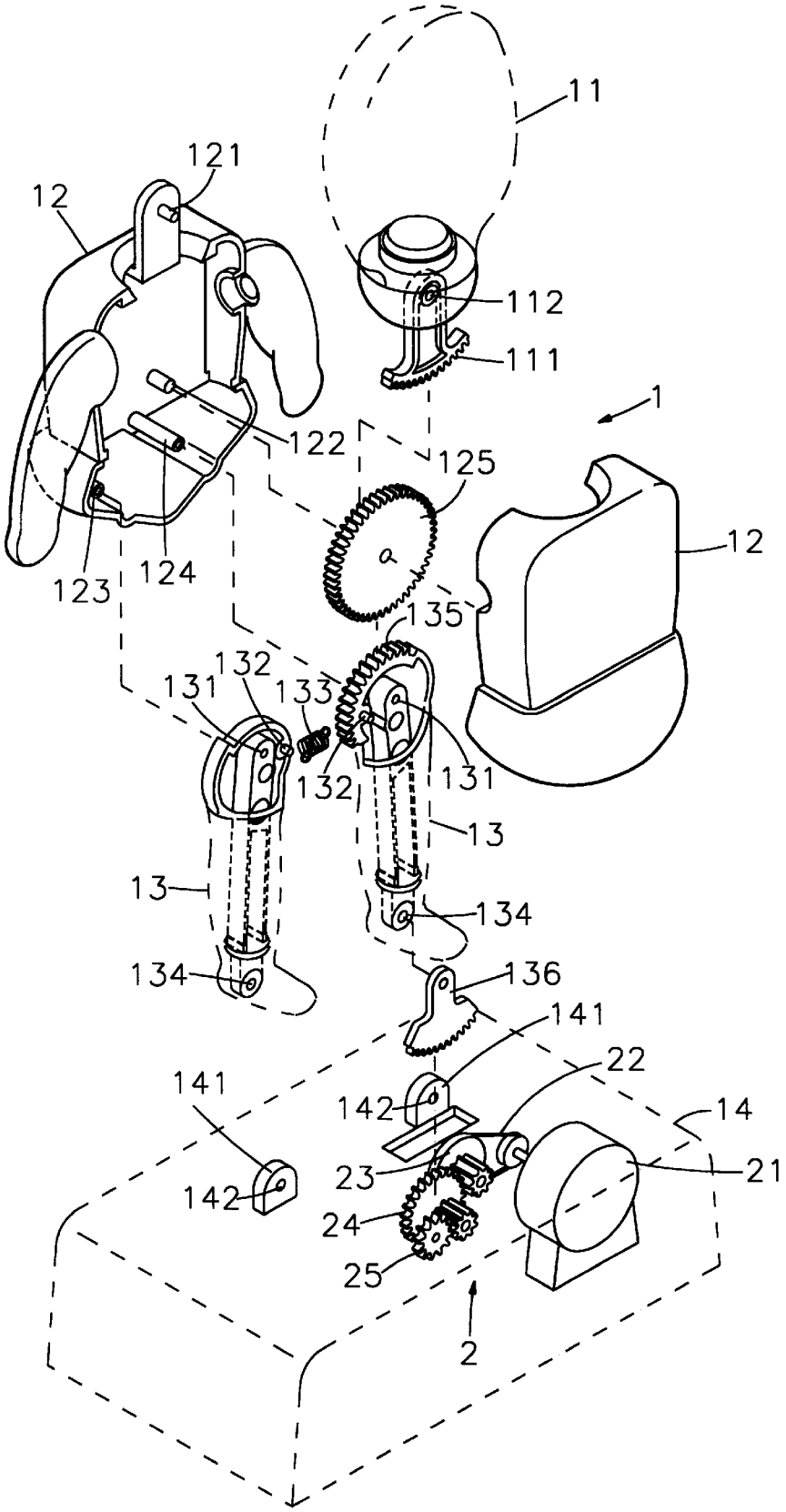
FIG. 1 is a perspective exploded view of a motion toy according to the present invention.
Figure 2:
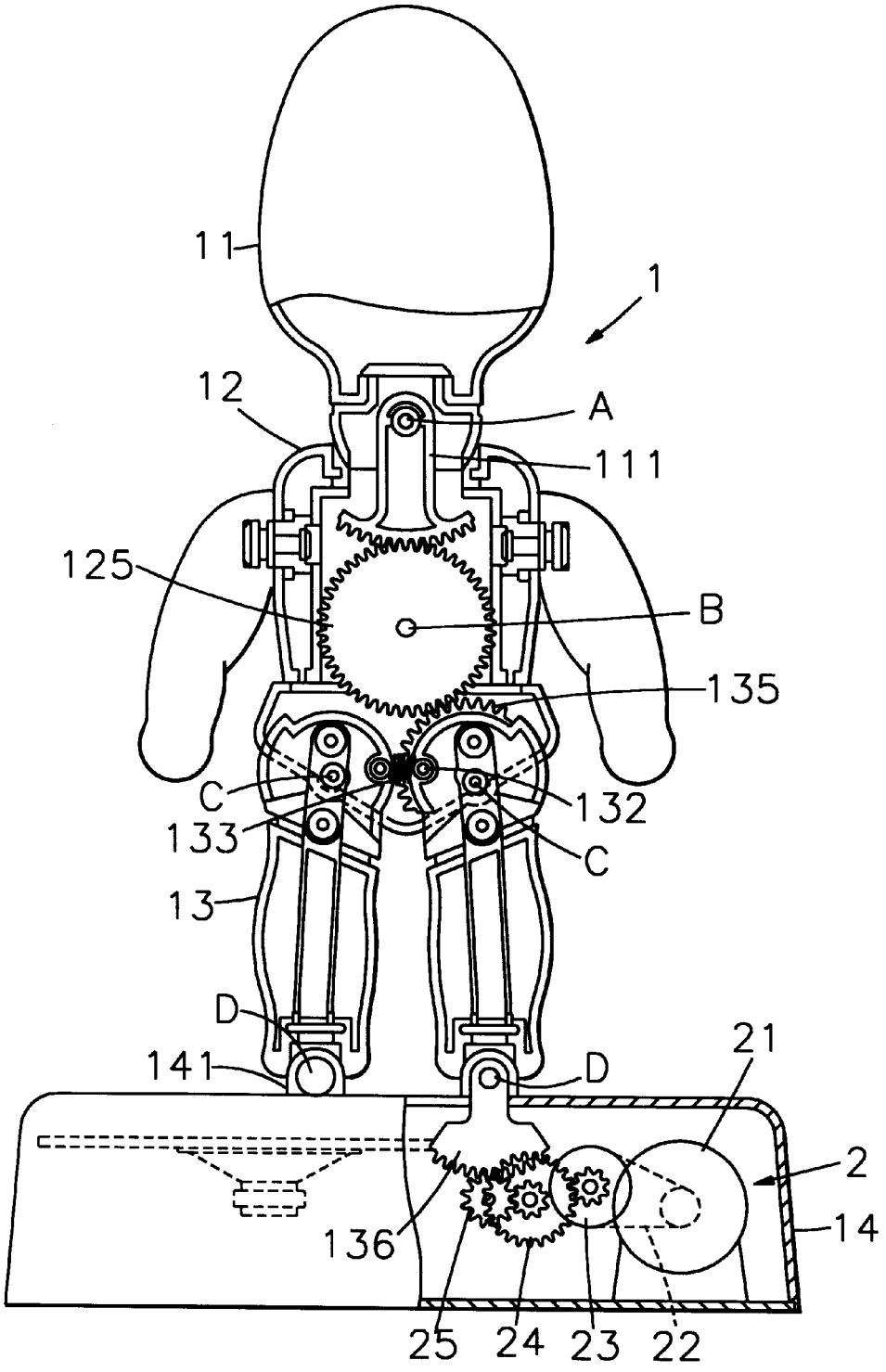
FIG. 2 is a perspective front view of the motion toy according to the present invention.

Referring to FIGS. 1 and 2, a motion toy in accordance with the present invention is shown comprised of a toy body 1, and a power drive 2.

The toy body 1 comprises a head member 11, a trunk member 12, two leg members 13, and a hollow base 14. The head member 11 comprises a smoothly arched bottom rack 111, and a transverse pivot hole 112 above the bottom rack 111. The trunk member 12 is formed of two symmetrical shells. One shell has a top pivot 121 transversely disposed at a top side and coupled to the pivot hole 112 at the head member 11, and a transverse axle 122 on the inside. A transmission gear 125 is mounted on the transverse axle 122 and meshed with the bottom rack 111. This same shell of the trunk member 12 has two bottom pivots 123 and 124 bilaterally disposed at a bottom side. The leg members 13 each have a first pivot hole 131 at one end (the top end) respectively coupled to the bottom pivots 123 and 124 of the trunk member 12, a second pivot hole 134 at an opposite end (the bottom end) respectively coupled to the base 14, and a retaining rod 132 disposed adjacent to the first pivot hole 131. A spring 133 is connected between the retaining rods 132 of the leg members 13 to pull the leg members 13 toward each other. One leg member 13 has a smoothly arched toothed portion 135 provided at the top end along the periphery and meshed with the transmission gear 125. The base 14 comprises two upright lugs 141, each upright lug 141 having a pivot hole 142. The second pivot holes 134 of the leg members 13 are respectively pivotally connected to the pivot holes 142 at the upright lugs 141 of the base 14 by pivot means. A sector gear 136 is connected to one leg member 13, and is inserted through a hole on the base 14 into engagement with the power drive 2.

The power drive 2 is mounted inside the base 14. The power drive of this preferred embodiment includes a reversible motor 21, a transmission belt 22, a belt pulley 23, a reduction gear 24, and an output gear 25. The belt pulley 23 is rotated by the motor 21 through the transmission belt 22 to turn the reduction gear 24, causing the reduction gear 24 to turn the output gear 25. The output gear 25 is meshed with the sector gear 136.

Referring to FIGS. 1 and 2 again, the pivot hole 112 of the head member 11 is coupled to the top pivot 121 of the trunk member 12, forming a top pivot point A. The transmission gear 125 is rotated on the axle 122, forming a center pivot point B. The first pivot holes 131 of the leg members 13 are respectively pivoted to the bottom pivots 123 and 124 of the trunk member 12, forming two middle pivot points C. The second pivot holes 134 of the leg members 13 are respectively pivoted to the pivot holes 142 at the upright lugs 141 of the base 14, forming two bottom pivot points D. The middle pivot points C and the bottom pivot points D form a four-bar linkage. The distance between the middle pivot points C is smaller than that between the bottom pivot points D. The bottom rack 111 at the top pivot point A and the toothed portion 135 at one middle pivot point C are respectively meshed with the transmission gear 125 at the center pivot point B.

Figure 3:
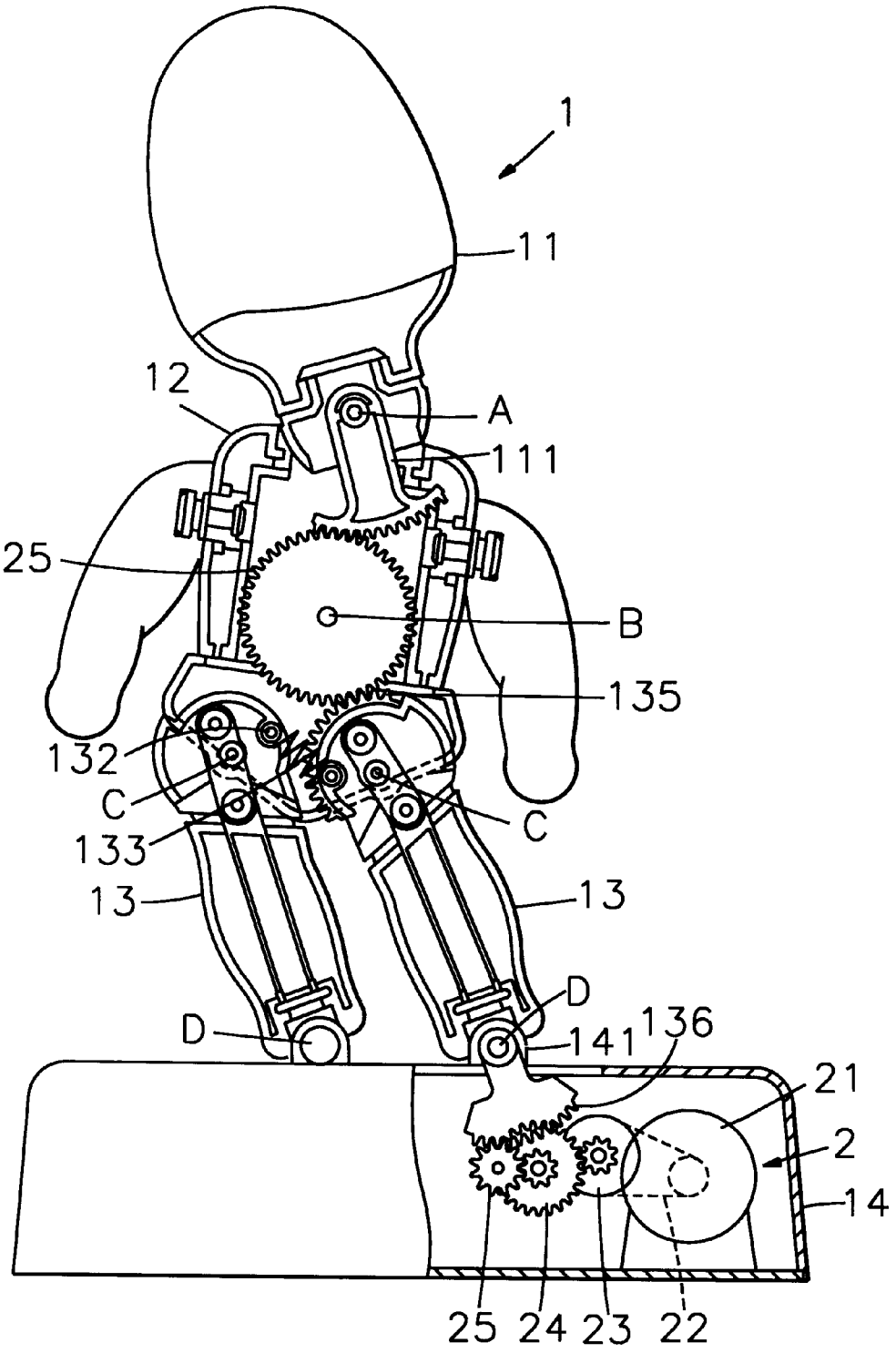
FIG. 3 illustrates the motion toy turned rightward according to the present invention.
Figure 4:
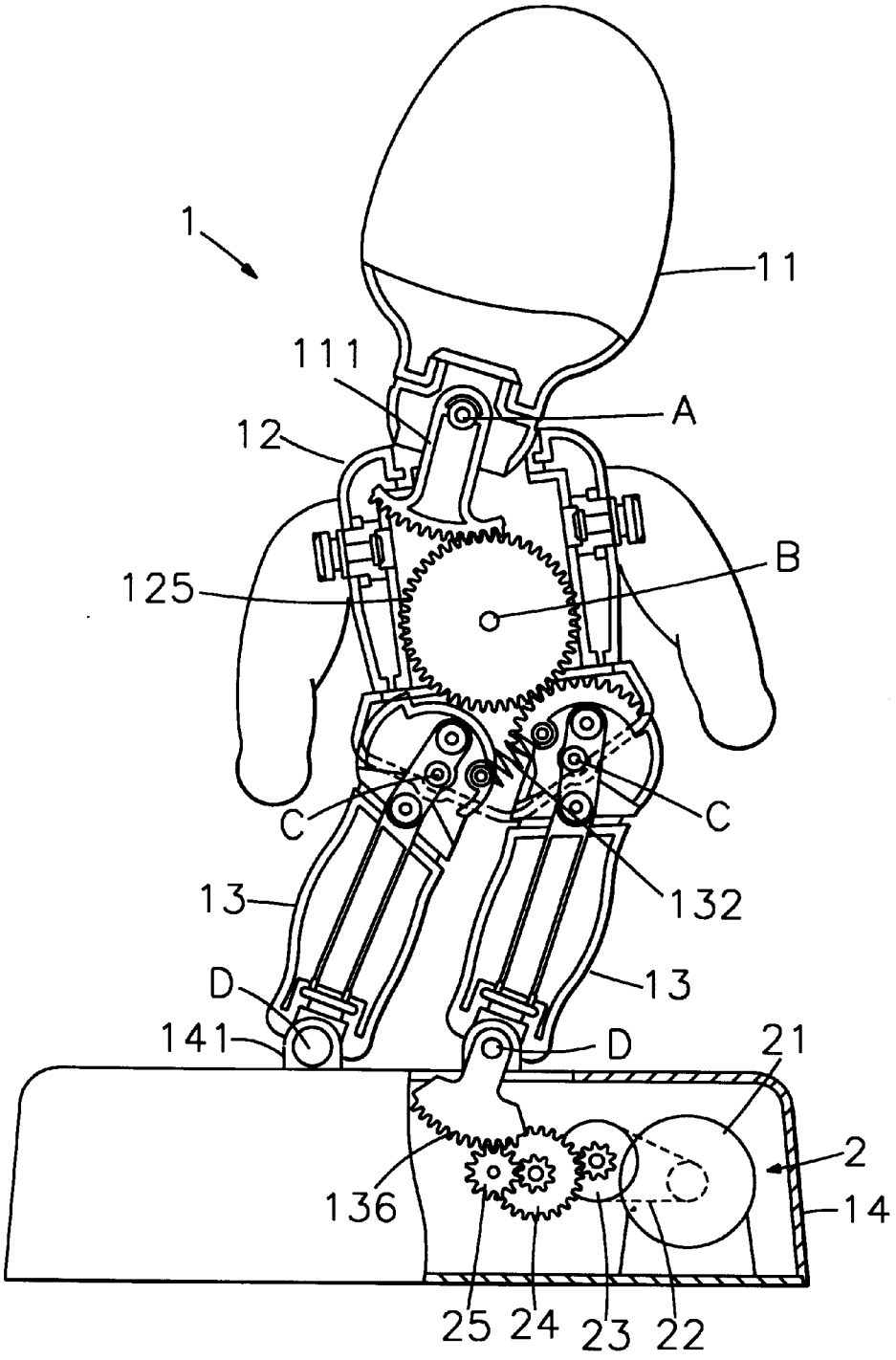
FIG. 4 illustrates the motion toy turned leftward according to the present invention.
Figure 5:
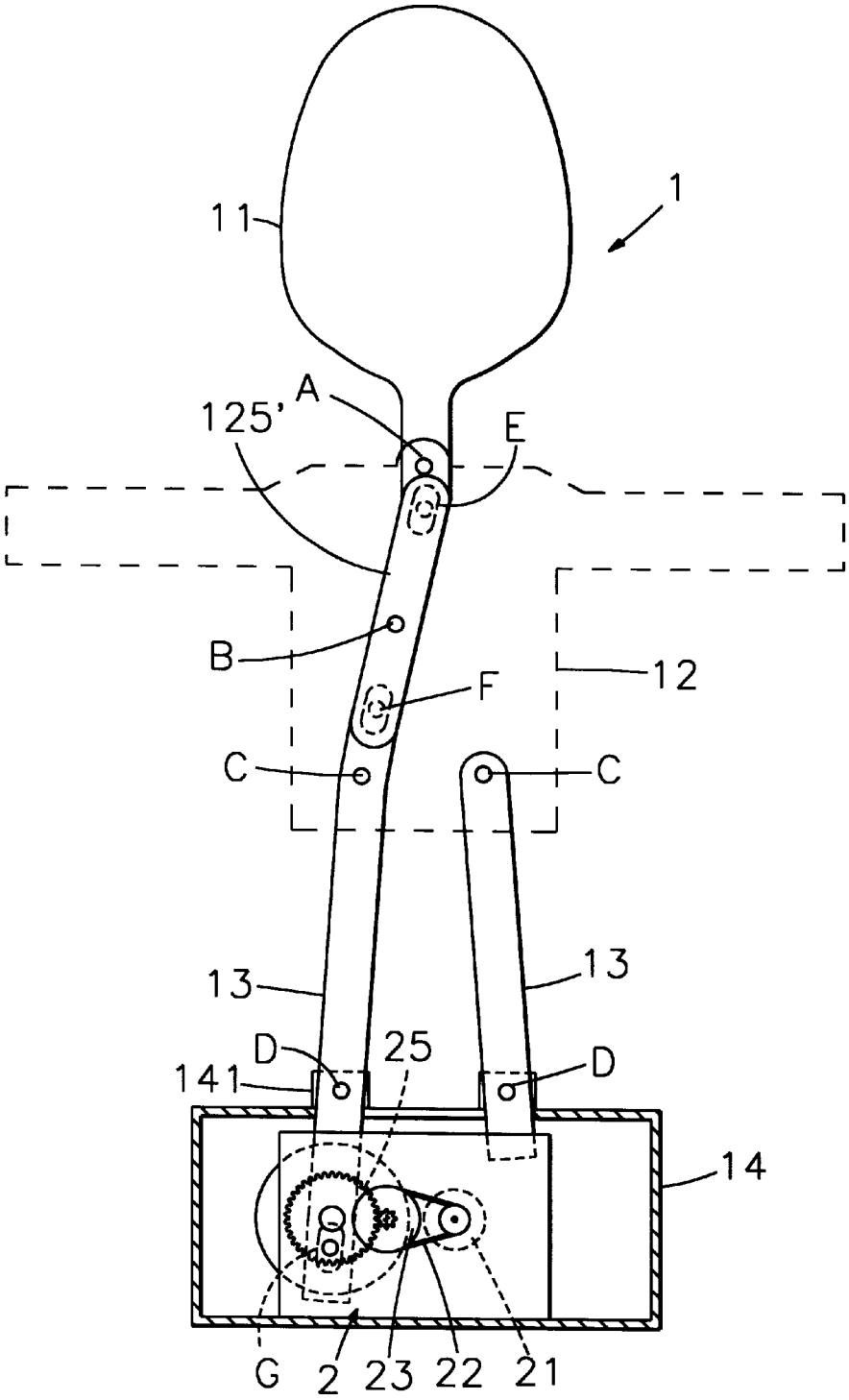
FIG. 5 is a perspective front view of an alternate form of the present invention.
Figure 6:
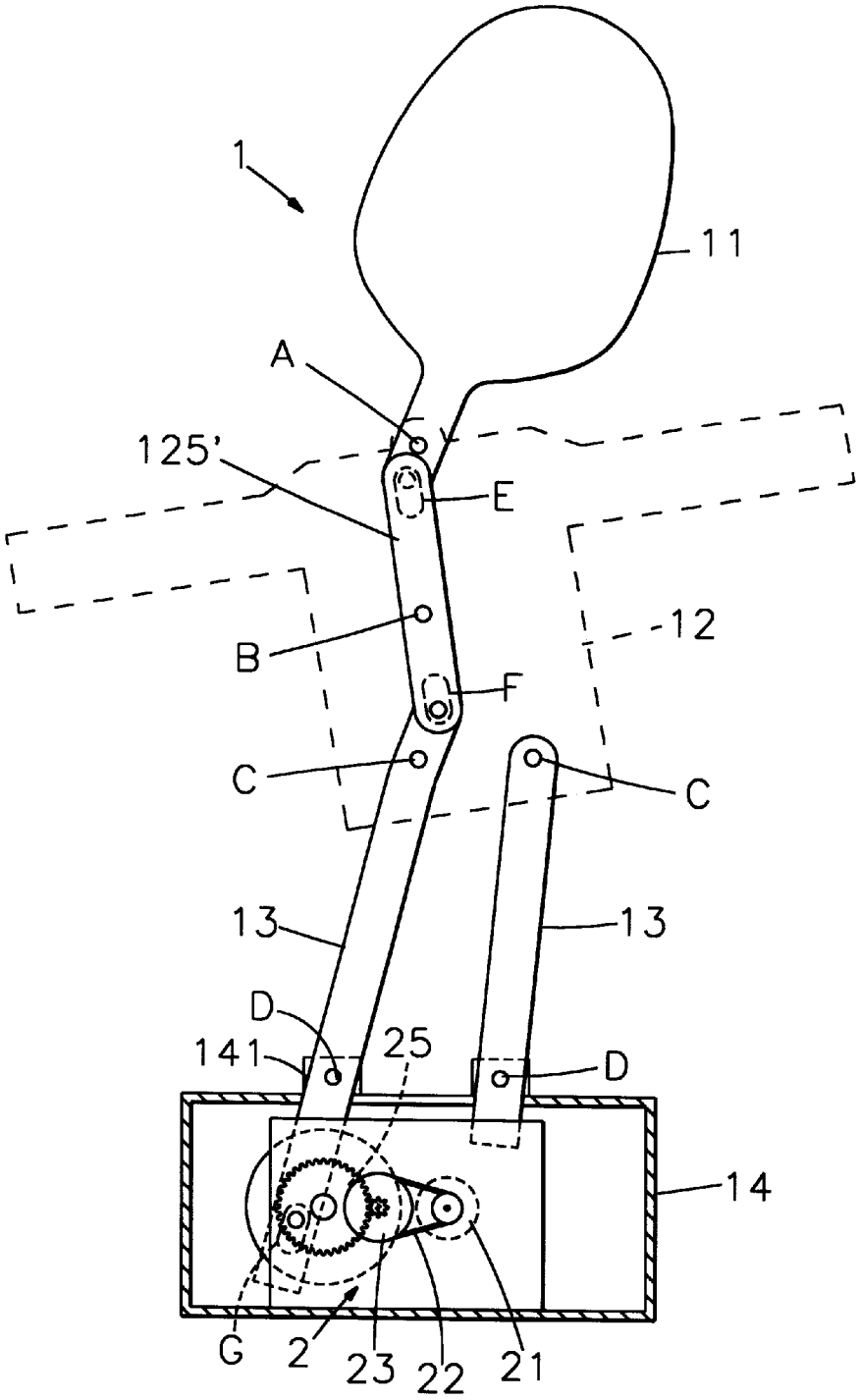
FIG. 6 illustrates the motion toy of FIG. 5 turned a rightward.
Figure 7:
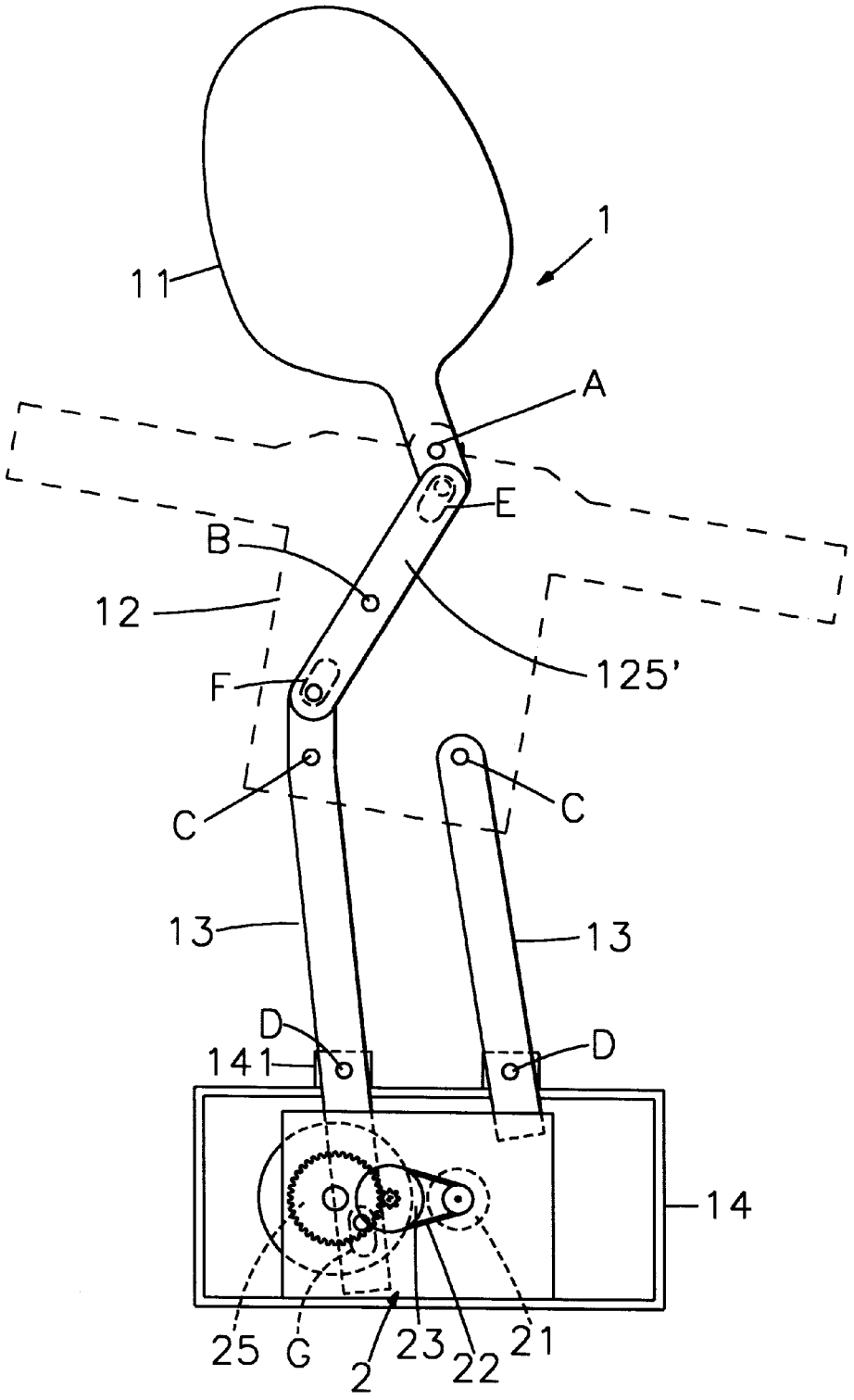
FIG. 7 illustrates the motion toy of FIG. 5 turned leftward.

Referring to FIGS. 3 and 4 and FIG. 2 again, when the reversible motor 21 is started to turn the belt pulley 23 clockwise/counter-clockwise through the transmission belt 22, the reduction gear 24 is driven by the pulley 23 to rotate the output gear 25, causing the sector gear 136 to oscillate the corresponding leg member 13. Because the leg members 13 are respectively pivoted to the bottom pivot points D and pulled together by the spring 133, oscillating one leg member 13 causes both leg members 13 to be synchronously oscillated. When the leg members 13 are turned back and forth, the transmission gear 125 is forced to rotate on the center pivot point B. When the transmission gear 125 is rotated, the bottom rack 111 is relatively moved, thereby causing the head member 11 to be turned back and forth on the top pivot point A.

FIGS. from 5 through 7 show an alternate form of the present invention. According to this alternate form, a link 125' is coupled between the head member 11 and one leg member 13. The link 125' has a top end coupled to the head member 11 by a slip joint E, and a bottom end coupled to the top end of one leg member 13 by a slip joint F. Further, the leg member 13 which is coupled to the link 125' has a bottom end coupled to the output gear 25 by a slip joint G.

It is to be understood that the drawings are designed for purposes of illustration only, and are not intended as a definition of the limit and scope of the invention disclosed.

What the invention claimed is:

1. A motion toy comprising:

a head member including a rack member;

a trunk member including a transmission gear, wherein the transmission gear movably engages with the rack member;

a first leg member having a first end and a second end, wherein the first end of the first leg member is pivotally mounted with respect to the trunk member;

a second leg member having a first end and a second end, wherein the first end of the second leg member is pivotally mounted with respect to the trunk member, wherein the first end of either the first leg member or the second leg member includes a toothed portion that movably engages with the transmission gear, and wherein the second end of the first leg member and the second end of the second leg member are maintained at a fixed distance from one another;

power drive means for moving the transmission gear, the rack member, and the toothed portion with respect to one another; and a spring means connected at the first end of the first leg member and the first end of the second leg member, wherein the spring means pulls the first and second leg members toward one another.

2. A motion toy, comprising:

a toy body, said toy body including a hollow base, a head member, a trunk member, and two legs members, said hollow base including two upright lugs raised from a top side wall thereof; said head member including a smoothly arched bottom rack and a transverse pivot hole above said bottom rack; said trunk member including a top pivot disposed at a top side and pivoted to the transverse pivot hole of said head member, two bottom pivots bilaterally disposed at a bottom side, a transverse axle spaced between said top pivot and said bottom pivots, and a transmission gear mounted on said transverse axle and meshed with the bottom rack of said head member; said leg members each having a first pivot hole at one end respectively pivotally connected to the bottom pivots of said trunk member and a second pivot hole at an opposite end respectively coupled to the pivots holes of the upright lugs of said hollow base, one of said leg members having a smoothly arched toothed portion at one end meshed with said transmission gear and a sector gear at an opposite end inserted through a hole defined in said hollow base; and a power drive mounted inside said hollow base and controlled to move said toy body, said power drive including a reversible motor, and a gear transmission mechanism meshed with said sector gear and driven by said reversible motor to move said sector gear.

3. The motion toy of claim 2, further comprising spring means connected between said leg members adjacent to said trunk member, said spring means provided to pull said leg members toward each other.

4. A motion toy comprising:

a toy body, wherein the toy body includes:

a head member, a rack member extending from the head member, a trunk member pivotally mounted with respect to the head member, a transmission gear provided with the trunk member, wherein the transmission gear movably engages with the rack member, a first leg member, wherein a first end of the first leg member is pivotally mounted with respect to the trunk member, and wherein the first end of the first leg member includes a toothed portion that movably engages with the transmission gear, a second leg member, wherein a first end of the second leg member is pivotally mounted with respect to the trunk member, a base member, wherein a second end of the first leg member is pivotally mounted with respect to the base member, and wherein a second end of the second leg member is pivotally mounted with respect to the base member, and a sector gear provided at the second end of the first leg member;

a power drive operably connected to the toy body so as to provide force to move the transmission gear, the rack member, and the toothed portion with respect to one another; and a spring means connected at the first end of the first leg member and the first end of the second leg member, wherein the spring means pulls the first and second leg members toward one another.

* * * * *